US007534284B2

(12) United States Patent
Thut et al.

(10) Patent No.: US 7,534,284 B2
(45) Date of Patent: May 19, 2009

(54) FLUX INJECTION WITH PUMP FOR PUMPING MOLTEN METAL

(75) Inventors: Bruno H. Thut, Chagrin Falls, OH (US); Thomas Moore, New Waterford, OH (US); David L. Baldwin, Danville, IN (US)

(73) Assignee: Bruno Thut, Chagrin Falls, OH (US)

( * ) Notice: Subject to any disclaimer, the term of this patent is extended or adjusted under 35 U.S.C. 154(b) by 181 days.

(21) Appl. No.: 11/691,664

(22) Filed: Mar. 27, 2007

(65) Prior Publication Data

US 2008/0236336 A1 Oct. 2, 2008

(51) Int. Cl.
*C22B 9/10* (2006.01)

(52) U.S. Cl. ..... 75/684; 75/708; 266/235

(58) Field of Classification Search ..... None
See application file for complete search history.

(56) References Cited

U.S. PATENT DOCUMENTS

| | | | |
|---|---|---|---|
| 1,865,918 | A | 7/1932 | Junkers |
| 2,472,412 | A | 6/1949 | Fritz |
| 2,808,782 | A | 10/1957 | Thompson et al. |
| 3,048,384 | A | 8/1962 | Sweeney et al. |
| 3,272,619 | A | 9/1966 | Sweeney et al. |
| 3,291,473 | A | 12/1966 | Sweeney et al. |
| 3,715,112 | A | 2/1973 | Carbonnel |

(Continued)

FOREIGN PATENT DOCUMENTS

| | | |
|---|---|---|
| CA | 2 528 757 | 6/2006 |

(Continued)

OTHER PUBLICATIONS

High Temperature Systems, Inc., Chipdog Series, T20002SDGI-40E Circulation Pump, printout from website (www.hitemp.com), 1 page.

(Continued)

*Primary Examiner*—George Wyszomierski
(74) *Attorney, Agent, or Firm*—Pearne & Gordon LLP

(57) ABSTRACT

A method of dispersing flux in molten metal includes providing a source of flux powder and a source of gas. An impeller is disposed on an end of a shaft inside the impeller chamber of a base made of heat resistant material. The base is submerged in the molten metal and includes a molten metal inlet opening into the impeller chamber and a molten metal discharge passageway extending from the impeller chamber to an exterior of the base. Molten metal is drawn through the inlet opening into the impeller chamber by rotation of the impeller in the impeller chamber. The molten metal is moved out of the impeller chamber through the discharge passageway by the rotation of the impeller. A discharge stream of molten metal travels through the discharge passageway into the molten metal exterior to the base. The gas flows from the gas source into a refractory flux conduit. The flux conduit extends from outside the molten metal into fluid communication with the discharge passageway. The flux solids move from the flux source to the flux conduit. The flux solids flow along the interior of the flux conduit by virtue of the flowing gas. The gas and flux solids are injected into the discharge stream in the discharge passageway. The flux solids are dispersed in the molten metal of the chamber.

7 Claims, 2 Drawing Sheets

U.S. PATENT DOCUMENTS

| | | | | |
|---|---|---|---|---|
| 3,753,690 | A | | 8/1973 | Emley et al. |
| 3,836,280 | A | | 9/1974 | Koch |
| 3,886,992 | A | | 6/1975 | Maas et al. |
| 3,984,234 | A | | 10/1976 | Claxton et al. |
| 3,997,336 | A | | 12/1976 | van Linden et al. |
| 4,003,560 | A | | 1/1977 | Carbonnel |
| 4,052,199 | A | | 10/1977 | Mangalick |
| 4,128,415 | A | | 12/1978 | van Linden et al. |
| 4,286,985 | A | | 9/1981 | van Linden et al. |
| 4,322,245 | A | | 3/1982 | Claxton |
| 4,351,514 | A | | 9/1982 | Koch |
| 4,426,068 | A | | 1/1984 | Gimond et al. |
| 4,456,424 | A | | 6/1984 | Araoka |
| 4,486,228 | A | | 12/1984 | Ormesher |
| 4,491,474 | A | | 1/1985 | Ormesher |
| 4,504,392 | A | | 3/1985 | Groteke |
| 4,518,424 | A | | 5/1985 | Ormesher |
| 4,743,428 | A | | 5/1988 | McRae et al. |
| 4,786,230 | A | | 11/1988 | Thut |
| 5,181,828 | A | | 1/1993 | Gilbert et al. |
| 5,203,681 | A | | 4/1993 | Cooper |
| 5,268,020 | A | | 12/1993 | Claxton |
| 5,312,232 | A | | 5/1994 | Horton et al. |
| 5,330,328 | A | | 7/1994 | Cooper |
| 5,443,187 | A | | 8/1995 | Samuelson |
| 5,468,280 | A | | 11/1995 | Areaux |
| 5,540,550 | A | | 7/1996 | Kubota |
| 5,586,863 | A | | 12/1996 | Gilbert et al. |
| 5,597,289 | A | | 1/1997 | Thut |
| 5,616,167 | A | * | 4/1997 | Eckert ..... 75/678 |
| 5,622,481 | A | | 4/1997 | Thut |
| 5,634,770 | A | | 6/1997 | Gilbert et al. |
| 5,662,725 | A | | 9/1997 | Cooper |
| 5,676,520 | A | | 10/1997 | Thut |
| 5,716,195 | A | | 2/1998 | Thut |
| 5,785,494 | A | | 7/1998 | Vild et al. |
| 5,842,832 | A | | 12/1998 | Thut |
| 5,860,575 | A | | 1/1999 | Akin et al. |
| 5,944,496 | A | | 8/1999 | Cooper |
| 5,947,705 | A | | 9/1999 | Mordue et al. |
| 5,951,243 | A | | 9/1999 | Cooper |
| 5,993,728 | A | | 11/1999 | Vild |
| 6,019,576 | A | | 2/2000 | Thut |
| 6,123,523 | A | | 9/2000 | Cooper |
| 6,152,691 | A | | 11/2000 | Thut |
| 6,217,823 | B1 | | 4/2001 | Vild et al. |
| 6,254,340 | B1 | | 7/2001 | Vild et al. |
| 6,303,074 | B1 | | 10/2001 | Cooper |
| 6,439,860 | B1 | | 8/2002 | Greer |
| 6,464,458 | B2 | | 10/2002 | Vild et al. |
| 6,505,674 | B1 | | 1/2003 | Sample et al. |
| 6,524,066 | B2 | | 2/2003 | Thut |
| 6,533,535 | B2 | | 3/2003 | Thut |
| 6,589,313 | B2 | | 7/2003 | Bilodeau et al. |
| 6,689,310 | B1 | | 2/2004 | Cooper |
| 6,881,030 | B2 | | 4/2005 | Thut |
| 2001/0028846 | A1 | | 10/2001 | Vild et al. |
| 2003/0205854 | A1 | | 11/2003 | Bilodeau et al. |
| 2005/0013715 | A1 | | 1/2005 | Cooper |
| 2006/0180962 | A1 | | 8/2006 | Thut |

FOREIGN PATENT DOCUMENTS

| | | |
|---|---|---|
| GB | 808 444 | 2/1959 |
| GB | 1 424 003 | 2/1976 |
| JP | 63-303014 | 12/1988 |
| JP | 10-05643 | 1/1989 |
| JP | 5-084564 | 4/1993 |
| JP | 8-309514 | 11/1996 |
| JP | 10-277726 | 10/1998 |

OTHER PUBLICATIONS

Metaullics, J-Series High Capacity Molten Metal Pump (product description), 14 pages.

Three pages containing Figs. 1-4 from U.S. Patent No. 6,019,576 showing pump and impeller sold more than one year before the filing date.

"Bimba position feedback cylinders," Brochure, pp. 7.5-6 (no date).

"Bimba position control system," Brochure, pp. 7.25, 7.26, 7.30 (no date).

"Elektrak 205," Brochure by Thomson, © 2003 Danaher Motion, pp. D-26, D-27, D-53, D-54 and D-57.

Schneider, R., "Working with position-feedback cylinder technology," http://www.bimba.com/techctr/schneidr.htm, printed May 24, 2005, reprinted from Hydraulics & Pneumatics, Sep. 1996.

Messina, Joseph P., "Pump handbook," Edited by Karassik, Igor J., et al., pp. 2.213-2.215.

* cited by examiner

FLUX INJECTION WITH PUMP FOR PUMPING MOLTEN METAL

FIELD OF THE INVENTION

The present invention is directed to pumps for pumping molten metal and the use of flux.

BACKGROUND OF THE INVENTION

Pumps for pumping molten metal are known and include various components depending on the application and the manufacturer, including circulation, transfer and gas purification pumps. A gas purification pump disclosed in U.S. Pat. No. 5,993,728 to Vild, is used for injecting chlorine gas into molten metal to react with magnesium such as from aluminum can scrap. The pump includes a submerged base having an interior impeller chamber having an inlet opening. A discharge passageway leads from the impeller chamber to an exterior of the pump. An impeller is rotated in the impeller chamber, which draws molten metal through the inlet into the impeller chamber and out the discharge passageway. The chlorine gas is injected into the discharge passageway. Chlorine gas is extremely toxic and may enter the surrounding area creating a hazardous workplace.

In conventional practice as shown by U.S. Pat. No. 4,052,199 to Vild, solid flux can be manually added to another chamber downstream of the pump. This practice is dangerous because the operator must be very near the molten metal when adding the flux. This is added to the molten metal in the case of aluminum can scrap to remove magnesium, which is present in aluminum cans in substantial amounts.

U.S. Pat. No. 6,589,313 discloses a hollow shaft on the end of which is an impeller. The shaft and impeller are rotated and positioned at an angle relative to the bath by a complex apparatus. Solid flux and gas is added to the rotating shaft and dispersed in the molten metal.

DISCLOSURE OF THE INVENTION

The present invention features a method of dispersing flux in molten metal. A source of flux solids and a source of gas are provided. Also provided is an impeller on an end of a shaft inside the impeller chamber of a base made of heat resistant material. The base is submerged in the molten metal. The base includes a molten metal inlet opening into the impeller chamber and a molten metal discharge passageway extending from the impeller chamber to an exterior of the base. Molten metal is drawn through the inlet opening into the impeller chamber by rotating the impeller in the impeller chamber. The molten metal is moved out of the impeller chamber through the discharge passageway by the rotation of the impeller. The discharge stream of molten metal travels through the discharge passageway into the molten metal at the exterior of the chamber. The gas flows from the gas source to a flux conduit comprised of refractory material. The flux conduit extends from outside the molten metal into fluid communication with the discharge passageway. The flux solids move from the flux source into the flux conduit. The gas traveling along the interior of the flux conduit causes the flux solids to move down the flux conduit. The gas and flux solids are injected into the discharge stream in the discharge passageway. The flux solids are dispersed in the molten metal.

The flux solids can be moved upwardly out of the flux source by rotating a screw-shaped delivery device, dropping the flux solids into a gas vortex and moving the flux solids to the flux conduit with gas from the gas vortex. The flux solids enter a hose and are moved along the hose to the flux conduit by flowing gas. The gases that are used advantageously can be free from chlorine gas. The gases can be inert gases (e.g., nitrogen or argon).

The present invention offers numerous advantages that have not been achieved by the prior art. First, the workplace is much safer using the present invention in the case where chlorine-free gases are employed. This avoids the risk of releasing dangerous chlorine gas into the workplace. Moreover, workers no longer need to come close to the molten metal to add flux. This occurs automatically using the flux dispersal system. Finally, the molten metal is much cleaner using the present invention compared to the conventional approach of manually adding flux to the bath with a lance. The present invention efficiently disperses the flux in the molten metal bath.

The prior art apparatuses described above do not achieve all of the advantages of the present invention. Although the Mangalick patent injects gas into a discharge passageway of a pump for pumping molten metal, solid flux is still added to the molten metal in a downstream chamber in the conventional way. The Vild patent does not address the use of flux. The Bilodeau patent does not inject flux along a flux conduit that extends to the discharge passageway of a molten metal pump.

DETAILED DESCRIPTION OF THE INVENTION

Figure 1:
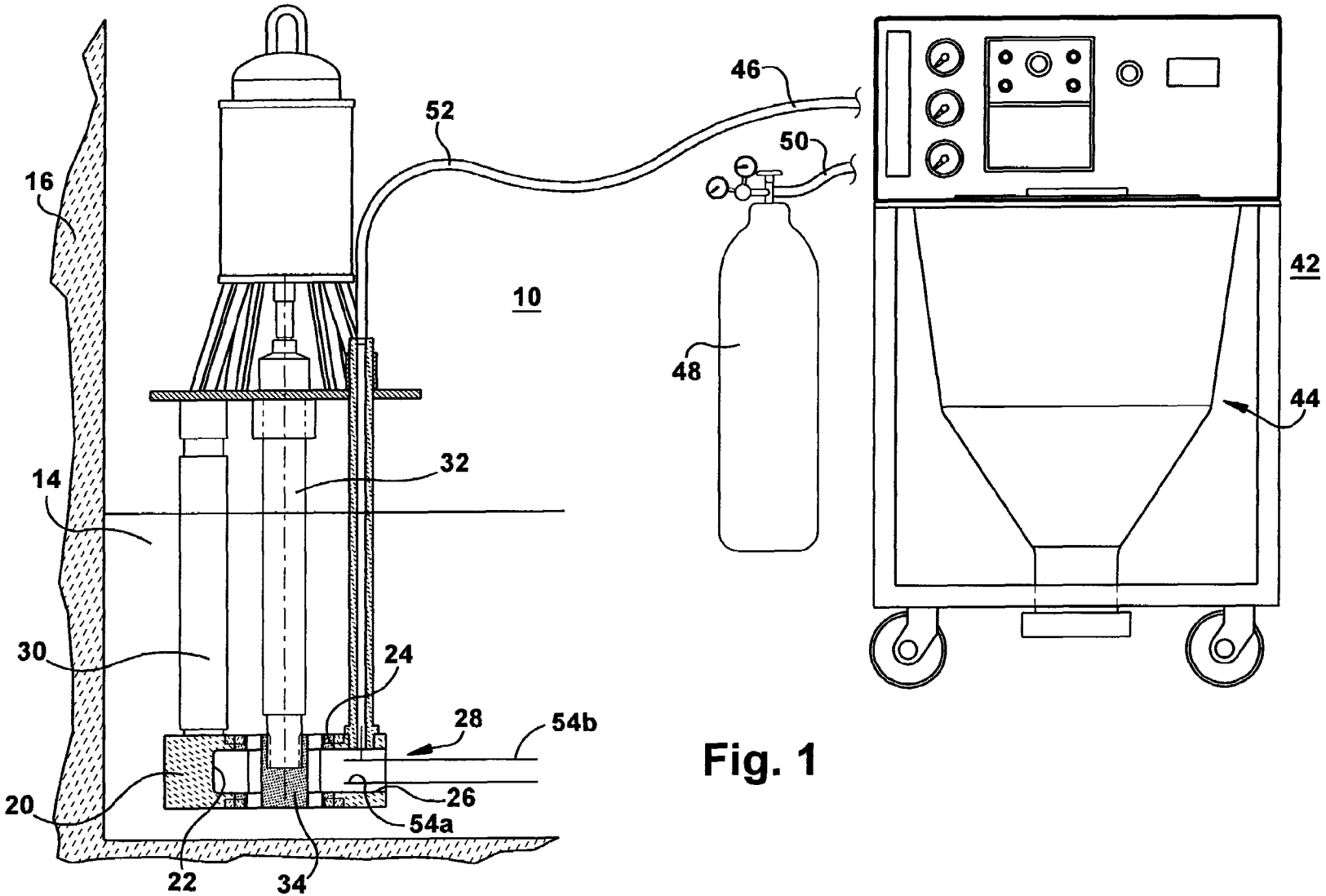
FIG. 1 is a vertical cross-sectional view of a pump constructed in accordance with the present invention designed to inject flux into molten metal, and a flux delivery machine.
Figure 2:
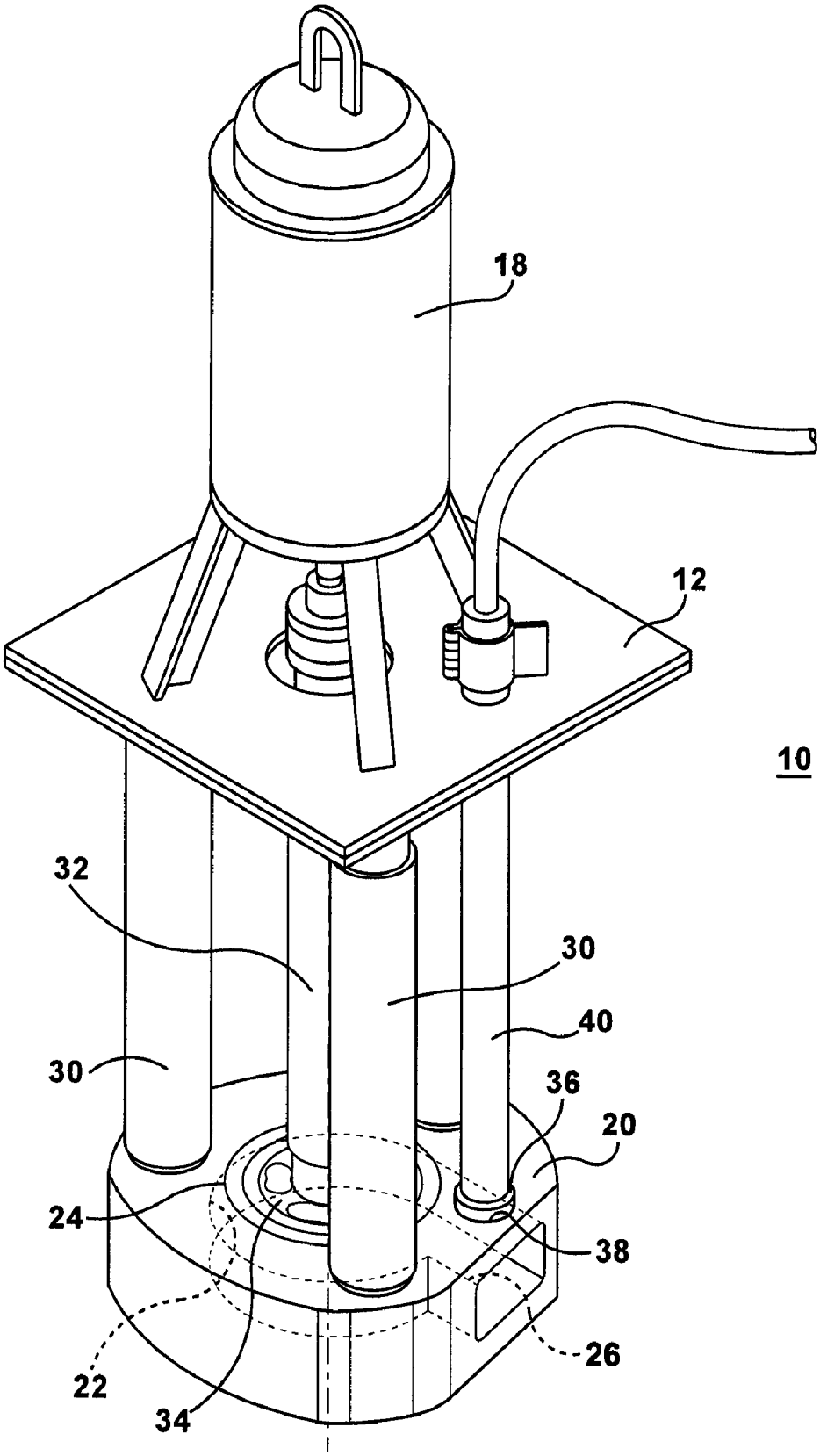
FIG. 2 is a perspective view of the pump shown in FIG. 1.

The method of injecting solid flux of the present invention employs a pump 10 for pumping molten metal. The pump and its components are well known. A motor mount 12 is disposed above molten metal 14 contained in a vessel or chamber 16. A motor 18 is carried by the motor mount. Submerged in the molten metal is a base 20 that includes the impeller chamber 22. A molten metal inlet opening 24 is disposed in the impeller chamber and a molten metal discharge passageway 26 extends from the impeller chamber to the exterior 28 of the base. The base 20 is submerged in the molten metal 14. The base is connected to the motor mount by support posts 30 that are cemented to the base and clamped to the motor mount. The motor rotates a shaft 32 and impeller 34 on the end of the shaft in the impeller chamber. The impeller chamber may include a volute or can be a nonvolute chamber, both known to those skilled in the art.

A flux coupling 36 is adapted to be received in an opening 38 in the base that extends into fluid communication with the pump discharge passageway. The lower end of flux conduit 40 can be inserted into the flux coupling. The upper end of the flux conduit is clamped to the motor mount. Therefore, the flux conduit can be readily removed when desired The present invention features the use of a flux delivery machine 42. One suitable flux delivery machine is sold by the company, Synex, and described by its brochure, which is incorporated herein by reference. The machine includes a hopper 44 for storing flux solids. Rotating a vertically extending screw serves to move the flux solids from the hopper toward flexible hose 46 extending from the hopper. Inside the hopper is a gas vortexer to which a gas source 48 is connected via hose 50. Flux solids travel upwardly by rotation of the screw and drop into the vortexer where they are directed into the flexible hose 46. The flux solids are moved in the flexible hose by the gas. Then, the gases travel into rigid stainless steel conduit disposed over the molten metal chamber. From the rigid conduit the flux solids are transported into the flux conduit 40 made of refractory material. The gas moves the flux solids into and along the flux conduit. The flux solids and gas are injected into the molten metal discharge stream 54*a* traveling in the discharge passageway. From there the flux solids in the discharge stream 54*b* exterior of the base are dispersed throughout the molten metal in the chamber or vessel.

The flux solids are in a form selected from the group consisting of powder, granulation, pellets and combinations thereof. Suitable flux is available, for example, from the company, Synex.

Referring now to specific aspects of the method, rotation of the impeller 34 in the impeller chamber 22 draws molten metal into the impeller chamber. The molten metal is moved out of the impeller chamber through the discharge passageway 26 by the rotation of the impeller. The discharge stream 54*a* of molten metal travels through the discharge passageway and into the molten metal 14 at the exterior of the chamber (54*b*). The gas flows from the gas source 48 into the gas vortexer, flexible hose 46, rigid conduit 52 and then into the flux conduit 40. The flux solids move from the hopper by rotation of the screw into the gas vortexer. The gas then moves the flux solids along the flexible hose 46, rigid conduit 52 and then the flux conduit 40. The gas and flux solids are injected into the discharge stream 54*a* in the discharge passageway. The flow of the molten metal in the discharge stream 54*b* external to the base disperses flux solids throughout the molten metal 14.

The injection of flux solids into the discharge passageway enables the molten metal to be efficiently dispersed throughout the molten metal at the exterior of the base. The molten metal moves rapidly as a discharge stream through the pump discharge and from the pump. This discharge stream carries the flux solids and rapidly distributes them throughout the bath. Without wanting to be bound by theory, it is believed that the injection into the pump discharge stream enables most, if not all, of the flux to be reacted before reaching the surface of the molten metal. This mixing of the flux and molten metal offers many advantages. Less flux may be needed to achieve the same amount of cleaning of the bath. On the other hand, a noticeable improvement in cleanliness of the bath has been achieved when injecting the flux into the molten metal discharge stream in the discharge passageway. Carrying out the flux reaction at a higher rate improves molten metal processing.

What is claimed is:

1. A method of dispersing flux in non-ferrous molten metal comprising:

providing a flux source of flux solids;

providing a source of gas;

providing an impeller on an end of a shaft inside an interior impeller chamber of a base made of heat resistant material, said base having an exterior surface, said base being submerged in the molten metal so that said exterior base surface contacts said molten metal, said base including a molten metal inlet opening extending from said exterior base surface into said impeller chamber and a molten metal discharge passageway extending from said impeller chamber to said exterior base surface;

drawing molten metal through said inlet opening into said impeller chamber by rotating said impeller in said impeller chamber;

moving the molten metal out of said impeller chamber through said discharge passageway by said rotation of said impeller, a discharge stream of molten metal traveling through said discharge passageway into the molten metal at the exterior of said impeller chamber;

flowing said gas from said gas source into a flux conduit comprised of refractory material, said flux conduit extending from outside said molten metal into fluid communication with said discharge passageway;

moving said flux solids from said flux source to said flux conduit;

flowing said flux solids along the interior of said flux conduit using said flowing gas;

injecting said gas and said flux solids into said discharge stream in said discharge passageway; and dispersing said flux solids in the molten metal exterior to the base.

2. The method of claim 1 wherein said gas includes no chlorine gas.

3. The method of claim 1 wherein said flux solids include a chlorine-containing compound.

4. The method of claim 1 wherein said gas is inert.

5. The method of claim 1 wherein said flux solids are in a form selected from the group consisting of powder, granulation, pellets and combinations thereof.

6. A method of dispersing flux in non-ferrous molten metal comprising:

providing a flux source of flux solids;

providing a source of gas;

providing an impeller on an end of a shaft inside an interior impeller chamber of a base made of heat resistant material, said base being submerged in molten metal, said base including a molten metal inlet opening into said impeller chamber and a molten metal discharge passageway extending from said impeller chamber to an exterior of said base;

drawing molten metal through said inlet opening into said impeller chamber by rotating said impeller in said impeller chamber;

moving the molten metal out of said impeller chamber through said discharge passageway by said rotation of said impeller, a discharge stream of molten metal traveling through said discharge passageway into the molten metal at the exterior of said chamber;

flowing said gas from said gas source into a flux conduit comprised of refractory material, said flux conduit extending from outside said molten metal into fluid communication with said discharge passageway;

moving said flux solids from said flux source to said flux conduit, comprising lifting said flux solids by rotating a screw-shaped delivery device, dropping said flux solids into a gas vortex and moving said flux solids to said flux conduit with gas from said gas vortex;

flowing said flux solids along the interior of said flux conduit using said flowing gas;

injecting said gas and said flux solids into said discharge stream in said discharge passageway; and dispersing said flux solids in the molten metal exterior to the base.

7. The method of claim 6 wherein said delivery device extends generally vertically.

* * * * *